US006304256B1

(12) United States Patent
Nagaya

(10) Patent No.: US 6,304,256 B1
(45) Date of Patent: Oct. 16, 2001

(54) DISPLAY UNIT

(75) Inventor: Masafumi Nagaya, Miyazaki (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 09/238,043

(22) Filed: Jan. 27, 1999

(30) Foreign Application Priority Data

Jan. 29, 1998 (JP) ..... 10-017410

(51) Int. Cl.[7] ..... G09G 5/00
(52) U.S. Cl. ..... 345/211; 345/212; 345/213
(58) Field of Search ..... 345/95, 211, 212, 345/213

(56) References Cited

U.S. PATENT DOCUMENTS 5,323,171 * 6/1994 Yokouchi et al. ..... 345/211
5,572,735 * 11/1996 Tanikawa ..... 345/211
5,793,346 * 8/1998 Moon ..... 345/211
5,838,294 * 11/1998 Praiswater ..... 345/102
5,859,632 * 1/1999 Ito ..... 345/211
6,005,541 * 12/1999 Takahashi et al. ..... 345/211

FOREIGN PATENT DOCUMENTS 7-104711 A 4/1995 (JP) .

* cited by examiner

*Primary Examiner*—Richard Hjerpe
*Assistant Examiner*—Kimnhung Nguyen
(74) *Attorney, Agent, or Firm*—Rabin & Berdo, P.C.

(57) ABSTRACT

The display device has the monitor circuit 50. The monitor circuit 50 senses the reduce of the supply voltage VDD. By sensing result, electrical charge stored capacitor 32, 34, and 36 is descharged becouse the wire 42, 44 and 46 respectively setes the ground voltage VSS. The cpacitor 32, 34 and 36 respectively coupled to wire 42, 44 and 46 for respectively transferring the display voltages.

22 Claims, 5 Drawing Sheets

DISPLAY UNIT

BACKGROUND OF THE INVENTION

1. Field of the Invention

This invention relates to a display unit such as a liquid crystal display. Particularly, the invention relates to controlling display voltages generated by a drive circuit.

2. Description of the Related Art

Recently, electronic devices such as a telephones or personal computer have began to incorporate device a display. Particularly, portable devices such as note-book type personal computers, portable telephones unit or portable television have become quite popular now. Each of these types of portable devices may include a liquid crystal display (hereinafter called "LCD").

The LCD has a LCD drive circuit to drive a display portion as display circuit. The LCD drive circuit generates a plurality of display voltages that are used by the display circuit. These display voltages are generated by activatting a booster circuit. For example, the booster circuit generates these display voltages based on a supply voltage supplied by a supply voltage source.

The booster circuit is popular to charge a pump system. For this case, the booster circuit has a capacitors store electrical charges used to charge a voltage source of the display circuit. These capacitors are coupled between corresponding wires and a reference voltage source such as a ground voltage source. Each of the wires transmit a correponding one of these display voltages generated by the booster circuit.

For the LCD drive circuit, when the supply voltage VDD decreases rapidly, electrical charge stored the capacitor does not discharge. Therefore, the wires leave electrical charge stored for a long time. As a result, the display portion of the display circuit leaves display. Thus, there occur instances in which information is displayed carelessly for viewing by a third party and there is a reduction in the life of the display circuit and malfunction or the like occur at restart-up, etc.

Particularly, when the portable device is in operation, the battery is removed without interrupting the power supply by a switch and the charged electrical charge is discharged. Therefore, it is necessary for the portable device to have the above problems solved.

For solving these problems, the solution measures further require more reliable operation when the supply voltage VDD is reduced.

The solution measures further require that there be no interference with a reduction in the size and cost of the display device itself.

SUMMARY OF THE INVENTION

The object of this invention is to provide a display device which can be provided wherein no display is left on the display part used as the display circuit by setting display voltages at a ground voltage level when a source voltage rises.

Another object of this invention is to provide a display device which operates more reliably when the supply voltage VDD is reduced.

A further other object of this invention is to provide a display device which does not interfere with a reduction in the size and cost of the display device itself.

A display device of this invention generates a plurality of display voltages according to a predetermined voltage and displays images by a display circuit according to these display voltages. The display device comprises a display voltage generating circuit that receives the predetermined voltage, and generates the display voltages corresponding to a first control signal; a plurality of wires, each wires transmitting a corresponding one of display voltages; a plurality of charge storage circuits being each charge storage circuits coupled to a corresponding one of the wires; a setting circuit that sets each voltage level of the wires at a predetermined value corresponding to a second control signal; and a monitor circuit supplied with the predetermined voltage, the monitor circuit monitoring a reduction in the predetermined voltage, and outputting another control signal when the monitor circuit senses a reduction in the predetermined voltage.

Typical embodiments of the present application are described herein in brief. However, the various embodiments of the present invention and specific configurations of these embodiments will be understood from the following description.

BRIEF DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

DETAILED DESCRIPTION OF THE PREFERRED EMBODIMENTS

Figure 1:
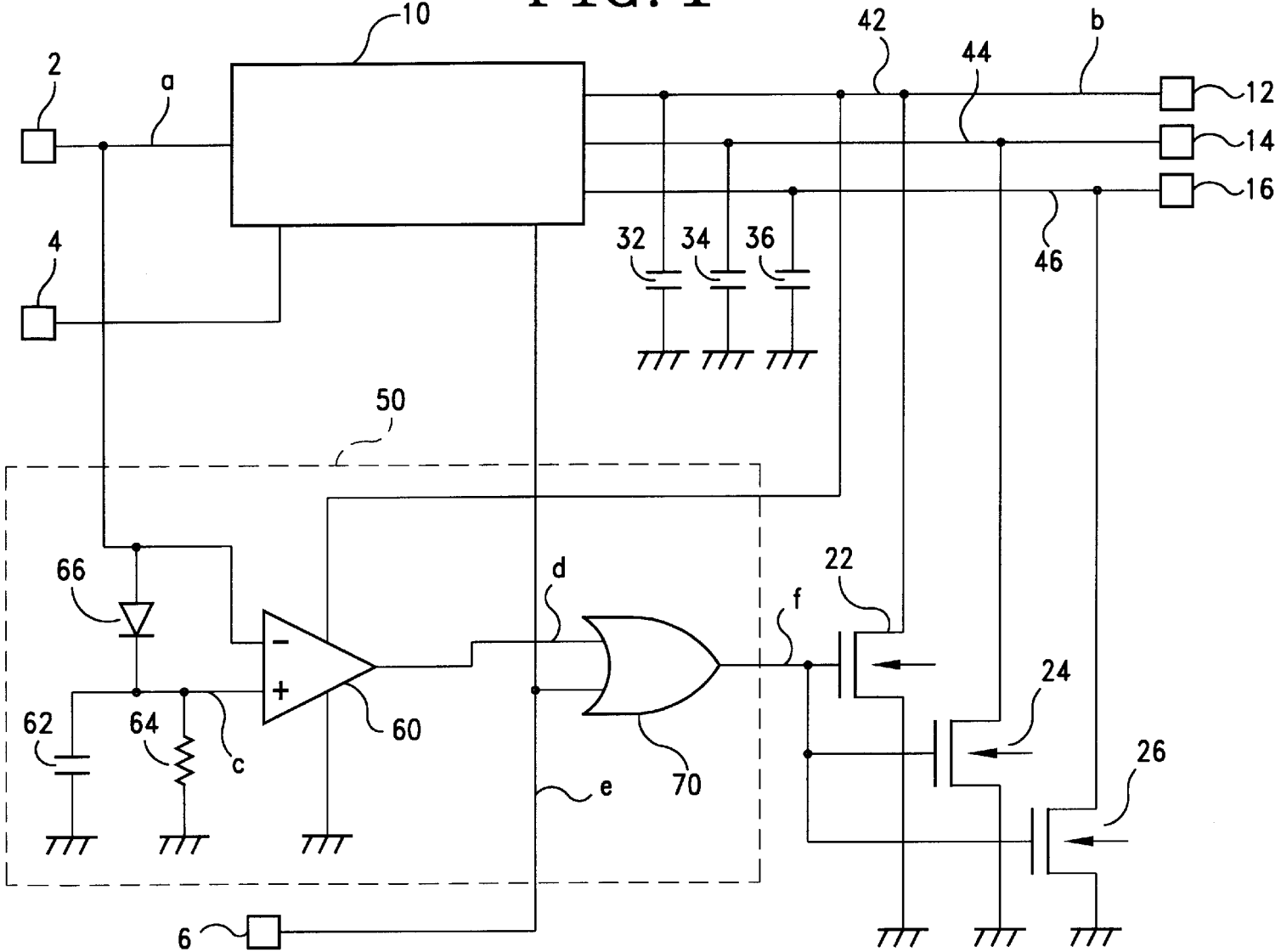
FIG. 1 is a circuit diagram showing a display device, particularly, a driver circuit according to a first embodiment of the present invention.

Display devices of the present invention will hereinafter be described in detail with reference to the accompanying drawings. FIG. 1 is a circuit diagram showing a display unit or device, particularly, a driver circuit 100 according to a first embodiment of the present invention. In the illustrated embodiment, a liquid crystal display (LCD) is used as the display device.

A source voltage VDD used as a first source voltage employed in the driver circuit 100 is a supply voltage source. As the source voltage VDD, there are known, for example, voltages supplied from the outside of the electronic device or equipment and voltages supplied from a battery incorporated into the electronic device. The supply source takes various forms. In particular, a chargeable-type source or a source that is removable from electronic equipment may be used as the battery.

Referring to FIG. 1, the driver circuit 100 comprises a step-up or booster circuit 10 corresponding to a display voltage generating circuit, N-channel MOS transistors 22, 24 and 26 each corresponding to a setting circuit, capacitors 32, 34 and 36 each corresponding to a charge storage circuit, and a monitor circuit 50.

The booster circuit 10 is supplied with both the source voltage VDD from terminal 2 and a reference voltage VREF, which is lower than the source voltage VDD, from a terminal 4. The booster circuit 10 boosts the source voltage VDD or the reference voltage VREF to thereby generate a plurality of display voltages V1, V2 and V3. Although the three voltages V1 to V3 are used as the display voltages in the present embodiment, the three display voltages are merely used to describe the present invention in a simple manner. Four or more display voltages may be prepared, as well. Although a specific circuit diagram of the booster circuit 10 is not illustrated, it may be configured so as to produce a plurality of display voltages by a charge pump system.

The display voltages V1, V2 and V3 generated from the booster circuit 10 are respectively transferred to conductors or wires 42, 44 and 46 for respectively transferring the display voltages. Therefore, a terminal 12 electrically connected to the wire 42 can be set to the display voltage V1. Similarly, a terminal 14 electrically connected to the wire 44 can be set to the display voltage V2, and a terminal 16 electrically connected to the wire 46 can be set to the display voltage V3.

The booster circuit 10 may stop its own boosting operation in response to a reset signal corresponding to a boost stop signal used as a first control signal inputted from a terminal 6. The reset signal is generated from an unillustrated central processing unit (hereinafter also called "CPU") when the boosting of the voltage is stopped.

A first electrode of the transistor 22 is electrically connected to the wire 42 and a second electrode thereof is supplied with a ground voltage VSS. A first electrode of the transistor 24 is electrically connected to the wire 44 and a second electrode thereof is supplied with the ground voltage VSS. A first electrode of the transistor 26 is electrically connected to the wire 46 and a second electrode thereof is supplied with the ground voltage VSS. Gate electrodes of the transistors 22, 24 and 26 may receive a reset signal used as a second control signal corresponding to the output of the monitor circuit 50. Therefore, the transistors 22, 24 and 26 electrically bring the wires 42, 44 and 46 and the ground voltage VSS into conduction in response to the reset signal corresponding to the output of the monitor circuit 50, respectively.

The capacitors 32, 34 and 36 are respectively electrically connected between the wires 42, 44 and 46 and a second voltage source such as the ground voltage VSS. These capacitors correspond to those for charging electrical charges required between their corresponding wires and the ground voltage VSS. An unillustrated display circuit electrically connected to the terminals 12, 14 and 16 is driven based on the charged electrical charges. These capacitors may be used as MOS capacitors comprised of MOS transistors. If so, then such configurations can be formed simultaneously in a process for manufacturing other configurations and can be taken into consideration together with the layout of other transistors even on a device layout.

The monitor circuit 50 comprises a comparator 60 used as a comparison circuit, a capacitor 62, a resistor 64 used as a impedance device, a diode 66 used as a rectifying device, and an NOR gate 70 used as a logic circuit for generating a reset signal.

A negative-side terminal corresponding to one input terminal of the comparator 60 is electrically connected to the terminal 2 so as to be supplied with the source voltage VDD. A positive-side terminal corresponding to the other input terminal of the comparator 60 is electrically connected to one terminal of the capacitor 62. The other terminal of the capacitor 62 is supplied with the ground voltage VSS. The resistor 64 is electrically parallel-connected to the capacitor 62. That is, the resistor 64 has one end electrically connected to the positive-side terminal of the comparator 60 and the other end supplied with the ground voltage VSS. The diode 66 has an anode used as a P-side terminal, which is electrically connected to the negative-side terminal of the comparator 60 and a cathode used as an N-side terminal, which is electrically connected to the positive-side terminal of the comparator 60.

A detect signal corresponding to a third control signal, which is outputted from an output terminal of the comparator 60, is inputted to one input terminal of the NOR 70. A reset signal inputted from the terminal 6 is inputted to the other input terminal of the NOR 70. The output of the NOR 70 is supplied to their corresponding gate electrodes of the transistors 22, 24 and 26 as the output of the monitor circuit 50.

Further, the comparator 60 is supplied with the voltage applied to the wire 42 and the ground voltage VSS. Namely, the comparator 60 may perform a comparison between the inputs from the negative-side terminal and the positive-side terminal according to the voltage of the wire 42 and the ground voltage VSS.

The capacitor 62, the resistor 64 and the diode 66 may be made up of a MOS capacitor comprised of a MOS transistor, a MOS resistor, and a MOS diode comprised of a diode-coupled MOS transistor, respectively. If so, then such configurations can be formed simultaneously in a process for manufacturing other configurations and can be taken into consideration together with the layout of other transistors even on a device layout.

Figure 2:
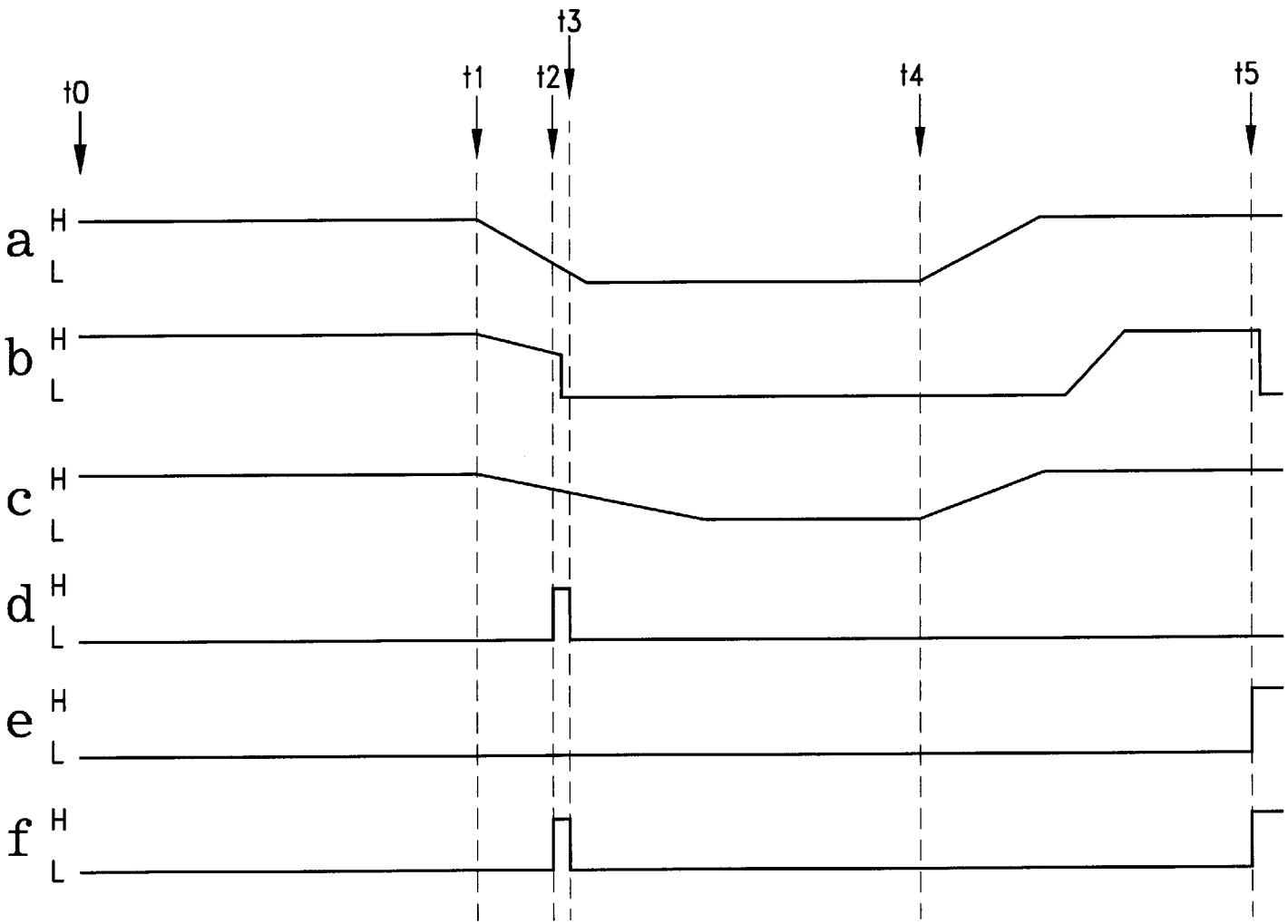
FIG. 2 is a timing chart for describing the operation of the driver circuit shown in FIG. 1.

The operation of the driver circuit 100 constructed in this way will be described below through the use the drawings. FIG. 2 is a timing chart for describing the operation of the driver circuit 100.

Referring to FIG. 2, a indicates a level (also corresponding to a voltage level supplied to the negative-side terminal of the comparator 60) of the source voltage VDD inputted from the terminal 2, b indicates a level of the display voltage V1 transferred through the wire 42, c indicates a voltage level supplied to the positive-side terminal of the comparator 60, d indicates a voltage level of the output of the comparator 60, e indicates a voltage level of the reset signal inputted from the terminal 6, and f indicates a voltage level of the output of the NOR 70, which is used as the output of the monitor circuit 50, respectively. H shown in FIG. 2 indicates a high level (which will be defined as the level of the source voltage VDD herein), and L indicates a low level (which will be defined as the level of the ground voltage VSS).

The source voltage VDD may be set to the high level at a timing t0 indicative of an initial state in FIG. 2. Further, the wire 42 may also be set to a voltage level VDD+$\alpha$ (where $\alpha$ indicates a voltage corresponding to a voltage portion boosted from the source voltage VDD) boosted by the booster circuit 10. Since a current flows through the diode 66 and the resistor 64 from the source voltage VDD, the negative-side terminal of the comparator 60 is set to a voltage level VDD−VBE (where VBE indicates the difference in voltage between the P-side terminal and the N-side terminal at the time that a forward current is caused to flow through the diode 66).

The comparator 60 is held in an operating state because the voltage level of the wire 42 has been boosted. The voltage VDD supplied to the negative-side terminal and the voltage VDD−VBE supplied to the positive-side terminal take the relations in VDD>. Therefore, the output of the comparator 60 is low in level.

The reset signal inputted from the terminal 6 is also set to the low level (when the reset signal is a level L, no instructions will be provided to stop the boosting operation of the booster circuit 10, whereas when the reset signal is at level H, instructions will be provided to stop the boosting operation of the booster circuit 10). Thus, since the voltages supplied to the two inputs of the NOR 70 are both low a level L, the output voltage of the NOR 70 is at level L. Therefore, the transistors 22, 24 and 26 are respectively inactive (turned off, and they are electrically nonconductive between the sources and drains thereof).

Although not illustrated in the drawing, the display voltages V2 and V3 will be considered as having been transferred to the wires 44 and 46 respectively. Therefore, electrical charges are charged into the capacitors 32, 34 and 36 respectively. The electrical charge will be regarded as having been charged even to the capacitor 62.

When the source voltage VDD is reduced for causes such as disconnection of a battery, etc. at a timing t1, the current, which flows through the diode 66 and the resistor 64, is also reduced. Therefore, the voltage at the positive-side terminal of the comparator 60 is reduced to the ground voltage VSS level by the time constant of the capacitor 62 and the resistor 64. With the discharge of the capacitor 62 based on the time constant of the capacitor 62 and the resistor 64, the speed at which the voltage at the positive-side terminal of the comparator 60 is reduced will be regarded as sufficiently slower than that at which the source voltage VDD is lowered.

The display voltage V1 transferred through the wire 42 is no longer raised because of the boosting of the booster circuit 10 is stopped incident to the reduction in the source voltage VDD. However, the speed at which the voltage of the wire 42 is lowered is slow due to the discharge of the capacitor 32. The wires 44 and 46 are also similar to the above. Therefore, even if the source voltage VDD is reduced, the display voltage is supplied to a display part corresponding to the display circuit. The first embodiment can solve this problem.

The comparator 60 capable of operation by the voltage of the wire 42, which is slow in reduction speed. Since, however, the source voltage VDD supplied to the negative-side terminal is higher than the voltage VDD−VBE supplied to the positive-side terminal at the initial time when the source voltage VDD is reduced, the output voltage of the comparator 60 remains at the low level.

Since the source voltage VDD is lowered, the reset signal is not produced either from the unillustrated CPU. Namely, the voltage of the reset signal remains low in level. Therefore, the voltages supplied to the two inputs of the NOR 70 are both taken low in level and hence the output voltage of the NOR 70 remains low in level. Thus, each of the transistors 22, 24 and 26 is in an inactive state. Although the source voltage VDD supplied to the negative-side terminal and the voltage VDD−VBE supplied to the positive-side terminal are both reduced, this state may be maintained until the voltage supplied to the negative-side terminal becomes lower than the voltage supplied to the positive-side terminal.

The level of the source voltage VDD supplied to the negative-side terminal of the comparator 60 may be considered as lower than the voltage VDD−VBE supplied to the positive-side terminal thereof at a timing t2. Therefore, the comparator 60 detects that the voltage at the negative-side terminal has become lower than the voltage at the positive-side terminal. As a result, the output voltage of the comparator 60 is taken high in level.

With a change in the level of the output voltage of the comparator 60, the output voltage of the NOR 70, which corresponds to the output of the monitor circuit 50, is also brought to the high level. With a change in the level of the output voltage of the NOR 70, the transistors 22, 24 and 26 may become active (i.e., held in the on state and they are electrically conductive between the sources and drains thereof).

With the activation of the transistors 22, 24 and 26, the electrical charges stored in the capacitors 32, 34 and 36 are discharged so that the voltages applied to the wires 42, 44 and 46 are respectively reduced to the ground voltage VSS. It is thus possible to prevent the display voltages from being supplied to the display part used as the display circuit. Since the voltage applied to both terminals of the diode 66 results in a voltage applied in the reverse direction upon the operation of these, the electrical charge of the capacitor 62 is not discharged. Therefore, when the driver circuit 100 is re-activated (when the source voltage VDD is brought to the high level again), for example, it can be expected that the comparator 60 can be restored to its original state at an earlier time.

Since the comparator 60 is not in operation at time t3 with the change of the voltage at the wire 42 to the low level, the output voltage of the comparator 60 is undefined (held in a high-resistance state). The output voltage of the comparator 60 is at a low level in FIG. 2 for simplification of its description. With its low level, the output voltage of the NOR 70 is also brought to the low level. Incidentally, the undefined state of the output of the comparator 60 continues until the voltage at the wire 42 for supplying the operating voltage to the comparator 60 reaches greater than or equal to VDD. However, the output voltage of the comparator 60 is at a low in level in FIG. 2.

At the timings times t2 and t3, the reset signal remains at a low level.

Thereafter, the driver circuit 100 is activated again at a timing t4, for example so that the source voltage VDD, the voltages applied to the wires 42, 44 and 46, the voltage at the positive-side terminal, the output voltage of the comparator 60, the voltage at the reset terminal 6 and the output voltage of the NOR are respectively brought to states similar to the initial state (timing t0).

When the voltage of the reset signal is at a high level according to instructions issued from the unillustrated CPU at a timing t5, for example, the output voltage of the NOR 70 changes to the high level. Therefore, the transistors 22, 24 and 26 are respectively brought into conduction so that the voltages at the wires 42, 44 and 46 can be reduced to the ground voltage VSS respectively.

According to the first embodiment, as has been described above in detail, when the source voltage VDD rises while the display devices is in operation, each display voltage can be set to the ground voltage VSS level. Thus, the display device can be provided wherein no display is left on the display part used as the display circuit. It is therefore possible to prevent displayed information from being shown to an unintended a third party and prevent a reduction in the life of the display circuit and a malfunction or the like at restart-up, etc.

Due to the application of the present invention to a portable device with a battery or cell as a power supply or source or a chargeable battery as a power supply, the aforementioned problems can be reliably prevented from arising even if, when the portable device is in operation, the battery is removed without interrupting the power supply by a switch and the charged electrical charge is discharged.

Since the comparator 60 of the driver circuit 100 employed in the first embodiment is activated based on the voltage other than the source voltage VDD, the display voltages can be reliably set to the ground voltage VSS. The comparator 60 can be activated based on the voltage at the wire 42 in the above-described embodiment. However, a voltage supply circuit unaffected by a reduction in another source voltage VDD may be provided so as to activate the comparator 60 based on a voltage supplied from the voltage supply circuit. However, since it is unnecessary to prepare a special voltage supply circuit, this will be more preferable for the aforementioned embodiment. Although the comparator 60 is supplied with the operating voltage from the wire 42, it may be supplied from another wire 44 or 46.

In the driver circuit 100 employed in the first embodiment, the monitor circuit 50 is further reduced in the number of devices and provided in a simple configuration. There is no interference with a reduction in size and cost of the display device itself.

Figure 3:
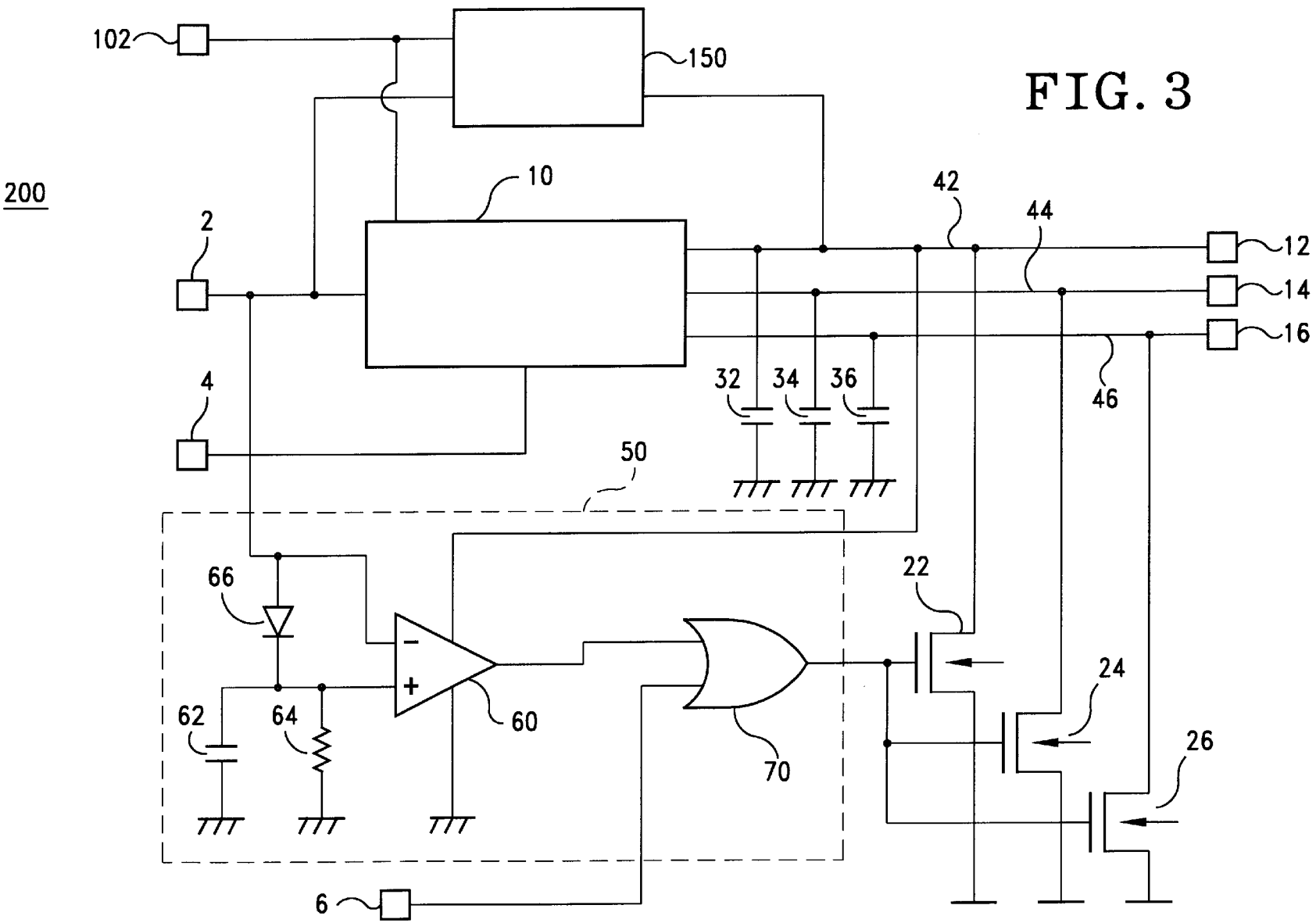
FIG. 3 is a circuit diagram illustrating a display device, particularly, a driver circuit according to a second embodiment of the present invention.

A display device according to a second embodiment of the present invention will next be described below in detail with reference to the drawings. FIG. 3 is a circuit diagram showing the display device, particularly, a driver circuit 200 according to the second embodiment of the present invention. In FIG. 3, the elements of structure similar to those in the driver circuit 100 employed in the first embodiment are identified by the same reference numerals.

The present embodiment is characterized in that a start-up circuit 150 used as a temporary supply circuit is provided in FIG. 3. The start-up circuit 150 has the function of short-circuiting a terminal 2 supplied with a source voltage VDD and a wire 42 for supplying a voltage for activating a comparator 60 temporarily (e.g., for a fixed time interval) in response to a set signal transferred from a terminal 102. The set signal corresponds to a signal used to provide instructions for the start of a boosting operation of a booster circuit 10 and is supplied from an unillustrated CPU. In FIG. 3, the instructions for the start of the boosting operation of the booster circuit 10 is not provided when the set signal at a low level, whereas when the set signal is temporarily at a high level, the instructions for the start of the boosting operation of the booster circuit 10 is given according to its change in level. Therefore, the set signal is transferred even to the booster circuit 10. When the set signal is placed at a high level, the instructions for the start of the boosting operation of the booster circuit 10 will be provided according to the high level.

Although no set signal is given in the first embodiment, the boosting operation may be started according to the set signal even in the driver circuit 100. Since no start-up circuit 150 is prepared within the driver circuit 100, the boosting operation may be started when the reset signal is low in level, for example.

Other elements of structure shown in FIG. 3 are similar to those employed in the driver circuit 100 according to the first embodiment.

Figure 4:
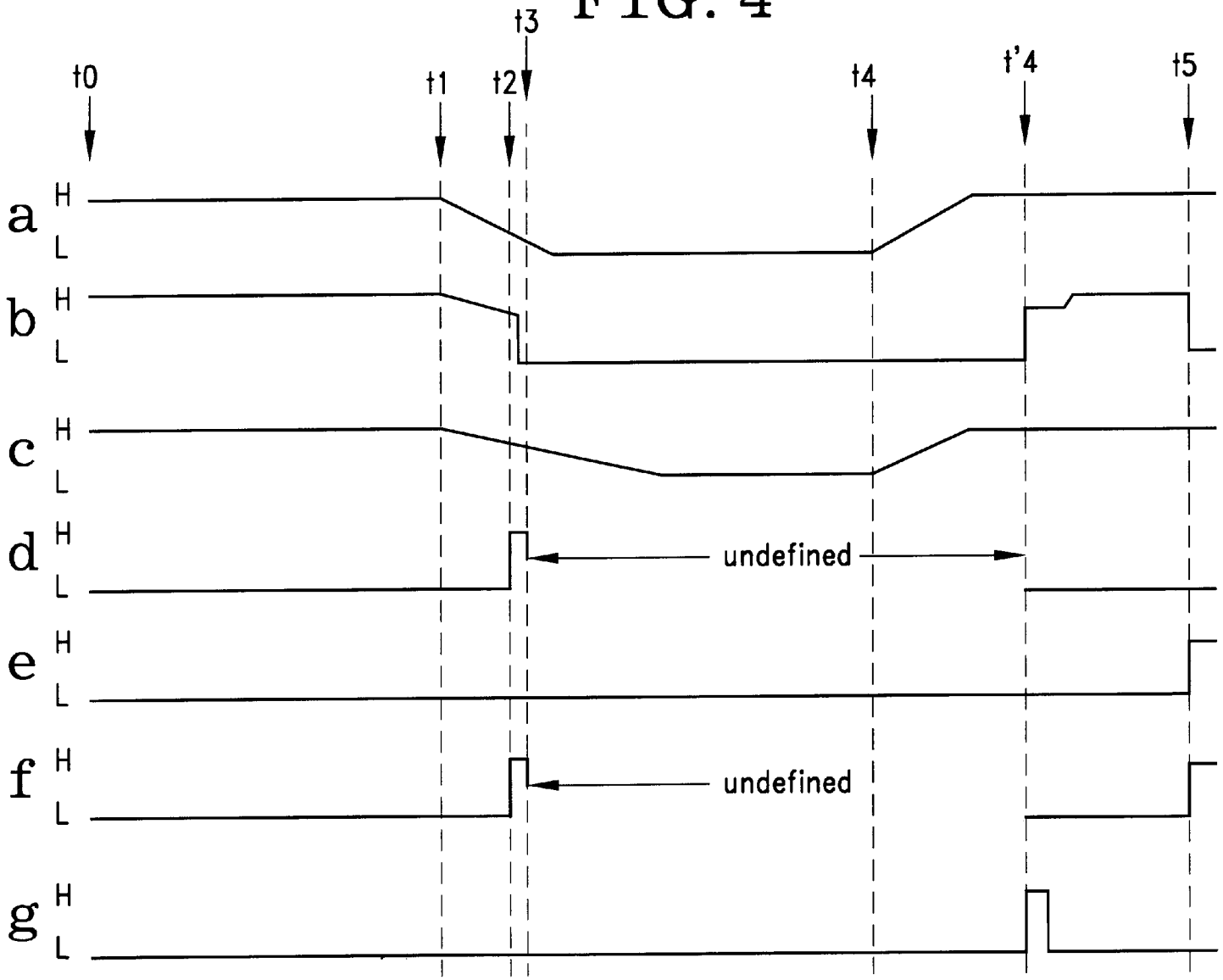
FIG. 4 is a timing chart for describing the operation of the driver circuit shown in FIG. 3.

The operation of the driver circuit 200 according to the second embodiment will be described below in detail with reference to the drawings. FIG. 4 is a timing chart for describing the operation of the driver circuit 200 according to the second embodiment.

At a timing t0 indicative of an initial state in FIG. 4, the voltage of the set signal is already temporarily high in level. Therefore, the source voltage VDD, voltages applied to wires 42, 44 and 46, a voltage applied to a negative-side terminal, a voltage outputted from a comparator 60, a voltage applied to a reset terminal 6, and a voltage outputted from a NOR gate 76 at the timing t0 are similar to those shown in FIG. 2. Since the voltage of the set signal is at a low level, the respective elements of structure in the driver circuit 200 are similar in operating state to the driver circuit 100. Therefore, their operations are similar to those shown in FIG. 2 until time t3.

Since the voltage at the wire 42 is brought to a ground voltage from the timing t3 up, the voltage required to activate the comparator 60 results in the ground voltage VSS. Therefore, the comparator 60 is deactivated so that the output voltage of the comparator 60 is undefined. With its undefined state, the output voltage of the NOR 70 is also undefined. In this case, it is considered that transistors 22, 24 and 26 are active so that their activation would interfere with increases in the voltages at the wires 42, 44 and 46 upon operation of the booster circuit 10. The second embodiment can solve such a problem.

At timing t4, the driver circuit 200 is re-activated to bring the voltage at the terminal 2 to the source voltage VDD level. Correspondingly, the voltage at the positive-side terminal of the comparator 60 is at a VDD−VBE level. Since the booster circuit 10 is not in operation, the comparator 60 is not supplied with the operable voltage from the wire 42.

At timing t4', the source voltage is stabilized at the VDD level and the voltage of the set signal changes from the low to high levels according to instructions issued from the unillustrated CPU. Therefore, the booster circuit 10 starts booting and the start-up circuit 150 temporarily short-circuits the terminals 2 and 12. Due to the operation of the start-up circuit 150, an electrical charge based on the source voltage VDD can be charged to a capacitor 32 at high speed. Even if the transistor 22 is in an activated state at this time, the capacitor 32 can be charged by an on resistance of the transistor 22. In order to charge the capacitor 32 more reliably, the on resistance of the transistor 22 may be set higher than on resistances of the transistors 24 and 26. Though all the on resistances of the transistors 22, 24 and 26 may be set high, only the on resistance of the transistor 22 may preferably be set high if consideration is given to the fact that the object of the present invention is more reliably put into effect.

Thus, when the voltage at the wire 42 is brought to the VDD level, the comparator 60 may be capable of operation. Since the negative-side terminal of the comparator 60 is supplied with the source voltage of the VDD level and the positive-side terminal of the comparator 60 is supplied with the voltage of the VDD−VBE level at this time, the output voltage of the comparator 60 may be determined to be low in level. Thereafter, when the reset signal is taken high in level (at a timing t5) or except when the source voltage VDD is reduced, the transistors 22, 24 and 26 are inactive.

As has been described above in detail, the second embodiment can achieve the object according to the first embodiment and prevent the interference with the supply of the voltage for activating the comparator 60 due to the undefined state of the output voltage of the comparator 60, whereby the object of the invention of the present application can be achieved more reliably.

Only the start-up circuit 150 is additionally provided in the second embodiment. If, for example, the start-up circuit 150 is provided as a simple configuration and used as a switch for short-circuiting between the terminals 2 and 12 in response to the set signal, then the configuration of the driver circuit 200 is not extensively increased. If a transistor is used as the switch, it may be then prepared simultaneously in a process for manufacturing other components of the driver circuit.

Figure 5:
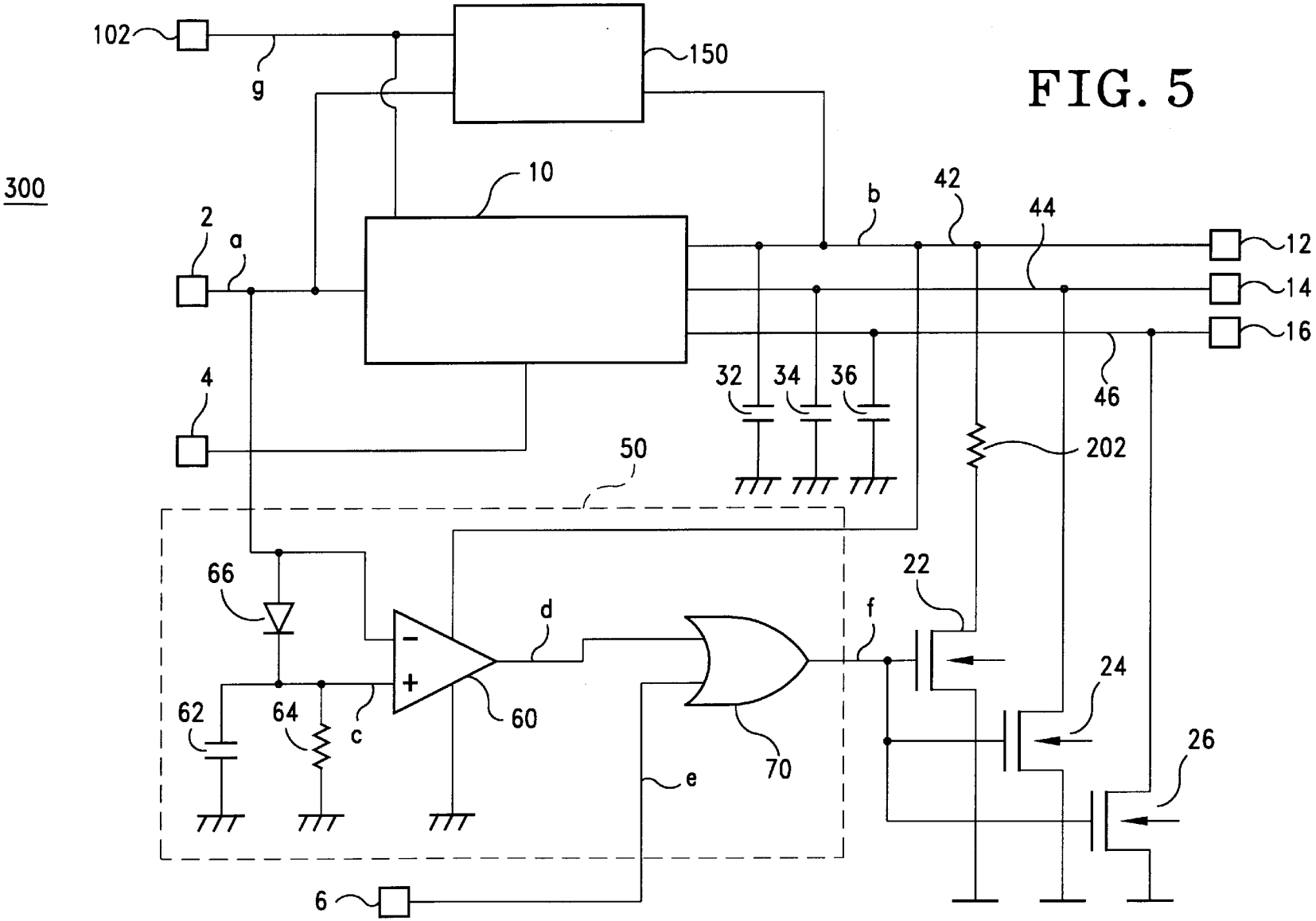
FIG. 5 is a circuit diagram showing a display device, particularly, a driver circuit according to a third embodiment of the present invention.

A display device according to a third embodiment will next be described below with reference to the drawings. FIG. 5 is a circuit diagram showing the display device, particularly, a driver circuit 300 according to the third embodiment of the present invention. In FIG. 5, the same elements of structure as those in the driver circuit 200 according to the second embodiment are identified by the same reference numerals.

In FIG. 5, a characteristic configuration is that a resistor 202 used as an impedance element or device is interposed in a wire for electrically connecting the terminal 12 and the transistor 22. Other configurations shown in FIG. 5 are similar to those employed in the driver circuit 200 shown in FIG. 3.

The operation of the driver circuit 300 shown in FIG. 5 will be explained below. Since the driver circuit 300 is substantially similar in operation to the driver circuit 200 except for portions related to the resistor 202, the description of its operation will be made by reference to the timing chart shown in FIG. 4.

The driver circuit 300 is activated in a manner similar to the driver circuit 200 till timings t0 to t2 in FIG. 4.

At timing t2, a voltage outputted from the comparator 60 changes from a low to a high levels. Correspondingly, a voltage outputted from a NOR gate 70 also changes from a low to a high levels. Therefore, transistors 22, 24 and 26 are held in an active state. Thus, electrical charges stored in capacitors 32, 34 and 36 are respectively discharged based on time constants of the respective capacitors and on resistances of the respective transistors. Since there is provided the resistor 202 at this time, the time constant for a voltage applied to a wire 42 will result in C1×(Rt1+RX). C1 indicates the capacitance value of the capacitor 32, Rt1 indicates the value of the on resistance of the transistor 22, and RX indicates the resistance value of the resistor 202.

Thus, the time constant for the wire 42 is greater than the time constants for the wires 44 and 46. In other words, the time required to discharge the wire 42 becomes greater than the time required to discharge the wires 44 and 46. That is, the wire 42 can supply a voltage for activating the comparator 60 for a longer time. As a result, the comparator 60 is restrained from stopping operating before the wires 44 and 46 are completely discharged. It is thus possible to achieve the object of the present invention more reliably. Further, the effect (charging made to the capacitor 32) of the second embodiment can be also achieved more reliably.

An effect similar to that obtained by the second embodiment can be achieved even by setting the capacity of the capacitor 32 so as to be larger than the capacities of other capacitors 34 and 36 as an alternative to the provision of the resistor 202.

The resistor 202 may more preferably be configured as a MOS resistor because it can be prepared simultaneously in a process for manufacturing other elements of structure employed in the driver circuit 300.

The display device, particularly, the driver circuit according to the present invention has been described above in detail. However, the display device of the present invention is not necessarily limited to the aforementioned configurations. Various modifications can be made thereto.

For example, the N-channel MOS transistor and the P-channel MOS transistor may be used in reverse. In this case, consideration is given even to the fact that the configuration of the NOR or the like also needs a change so as to meet the operation of each embodiment referred to above.

Further, the aforementioned embodiments have been described as LCDs. However, if another display device, which is capable of using a driver circuit similar to that employed in the present invention, is adopted, then the present invention can be applied thereto.

What is claimed is:

1. A display drive circuit for generating a plurality of display voltages from a first voltage $V_1$ comprising:

a display voltage generating circuit that uses the first voltage to generate display voltages for driving a display, and inhibits generation of the display voltages in response to a first control signal;

a plurality of conductive lines, each of which transmits a corresponding one of the display voltages;

a plurality of charge storage circuits, each of which is coupled to a corresponding one of said conductive lines;

a setting circuit that sets said conductive lines to a second voltage in response to a second control signal; and a monitor circuit that is supplied with the first voltage, wherein said monitor circuit generates a third control signal when the first voltage decreases, and outputs the third control signal or the first control signal as the second control signal.

2. A display drive circuit according to claim 1, wherein an electrical charge of one of said charge storage circuits drives said monitor circuit.

3. A display drive circuit according to claim 2, wherein said display voltage generating circuit generates said display voltages in response to a fourth control signal, and wherein said display drive circuit further comprises a temporary supply circuit that supplies the first voltage to one of said conductive lines which is coupled to said monitor circuit in response to the fourth control signal.

4. A display drive circuit according to claim 3, further comprising a resistance circuit coupled between said one of said conductive lines which is coupled to said monitor circuit and said setting circuit.

5. A display drive circuit according to claim 3, wherein a capacity of said one of said charge storage circuits is greater than a capacity of each of the other charge storage circuits.

6. A display drive circuit according to claim 3, wherein said setting circuit comprises a plurality of transistors, each of said transistors including:

a first electrode that is coupled to a corresponding one of said conductive lines, a second electrode that is supplied with the second voltage, and a control electrode that receives the second control signal, and wherein an ON-resistance value of one of said transistors which is coupled to said one of said charge storage circuits is greater than an ON-resistance value of each of the other transistors.

7. A display drive circuit according to claim 1, wherein the first voltage is supplied from a removable voltage supply circuit.

8. A display drive circuit according to claim 7, wherein said display drive circuit and said voltage supply circuit are disposed in a portable device.

9. A display drive circuit according to claim 3, wherein the first voltage is supplied from a removable voltage supply circuit.

10. A display drive circuit according to claim 9, wherein said display drive circuit and said voltage supply circuit are disposed in a portable device.

11. A display drive circuit according to claim 4, wherein the first voltage is supplied from a removable voltage supply circuit.

12. A display drive circuit according to claim 11, wherein said display unit and said voltage supply circuit are disposed in a portable device.

13. A display drive circuit driving a display with a plurality of drive voltages, comprising:

a plurality of drive terminals, each of said drive terminals being supplied with one of the drive voltages;

a plurality of capacitors, each of said capacitors being connected to a respective one of said drive terminals;

a driver circuit that is connected to said drive terminals, said drive circuit providing the drive voltages to said drive terminals from a first voltage supplied thereto;

a monitoring circuit that is supplied with the first voltage, said monitoring circuit outputting a first control signal when a level of the first voltage decreases; and a discharge circuit that is connected to said drive terminals, said discharge circuit discharging said drive terminals to a second voltage in response to the first control signal.

14. A display drive circuit according to claim 13, wherein said monitoring circuit is connected to one of said drive terminals and is driven by one of said drive voltages.

15. A display drive circuit according to claim 13, wherein said monitoring circuit includes:

a reference voltage generator that generates a reference voltage; and a comparator that includes:

a first input terminal that receives the first voltage, a second input terminal that receives the reference voltage from said reference voltage generator, and an output terminal that outputs a comparison signal indicating a comparison between the first voltage and the reference voltage.

16. A display drive circuit according to claim 15, wherein said reference voltage generator includes:

a diode having an anode that receives the first voltage and a cathode connected to the second input terminal of said comparator;

a capacitor having a first terminal connected to said cathode and a second terminal that receives the second voltage; and a resistor having a first terminal connected to said cathode and a second terminal coupled that receives the second voltage.

17. A display drive circuit according to claim 15, wherein said monitoring circuit further includes a gate circuit having a first input terminal connected to the output terminal of said comparator, a second terminal that receives a reset signal and an output terminal that outputs the control signal.

18. A display drive circuit according to claim 17, wherein said driver circuit stops operation thereof in response to the reset signal.

19. A display drive circuit according to claim 15, wherein said comparator is connected to one of said drive terminals and is driven by one of said drive voltages.

20. A display drive circuit according to claim 14, wherein said discharge circuit includes a plurality of transistors, each of said transistors having a control terminal that receives the control signal, a first terminal connected to one of said drive terminals and a second terminal that receives the second voltage.

21. A display drive circuit according to claim 13, further comprising a start-up circuit that receives the first voltage, said start-up circuit providing the first voltage to said one of said drive terminals in response to a start-up signal received thereat.

22. A display drive circuit according to claim 21, further comprising a resistor coupled between said one of said drive terminals and said discharge circuit.

* * * * *